US007012541B2

(12) United States Patent
Ibguy

(10) Patent No.: US 7,012,541 B2
(45) Date of Patent: Mar. 14, 2006

(54) BABY BOTTLE COMBINED WITH MUSICAL TEDDY BEAR

(75) Inventor: Meir Ibguy, 632 Kings Hwy., Apt-3C, Brooklyn, NY (US) 11223

(73) Assignee: Meir Ibguy, Brooklyn, NY (US)

( * ) Notice: Subject to any disclaimer, the term of this patent is extended or adjusted under 35 U.S.C. 154(b) by 0 days.

(21) Appl. No.: 10/095,356

(22) Filed: Mar. 12, 2002

(65) Prior Publication Data

US 2003/0173491 A1 Sep. 18, 2003

(51) Int. Cl.
*G08B 21/00* (2006.01)

(52) U.S. Cl. ..... 340/689; 340/686.1; 340/691.1; 340/692; 340/693.5; 340/573.1; 222/105; 222/95; 215/11.1; 215/11.3; 215/12.1; 248/102

(58) Field of Classification Search ..... 340/689, 340/686.1, 691.1, 692, 693.5, 973.1; 222/105, 222/95; 215/11.1, 11.3, 12.1; 248/102
See application file for complete search history.

(56) References Cited

U.S. PATENT DOCUMENTS

| | | | | | |
|---|---|---|---|---|---|
| 4,678,093 | A * | 7/1987 | Allen | 215/11.1 |
| 4,944,704 | A * | 7/1990 | Grace | 446/74 |
| 5,114,374 | A * | 5/1992 | Estiva | 446/77 |
| 5,344,034 | A * | 9/1994 | Eagan | 215/11.1 |
| 6,158,870 | A * | 12/2000 | Ramirez | 362/101 |
| 6,237,787 | B1 * | 5/2001 | Gallo et al. | 215/12.1 |

* cited by examiner

*Primary Examiner*—Daniel Wu
*Assistant Examiner*—Tai T. Nguyen

(57) ABSTRACT

The present invention offers a baby bottle combined with a musical teddy bear. The item comprises two elements: a baby bottle and a holder. The holder includes two parts: a toy—a stuffed teddy bear and a plastic ring on the top of the head of the teddy bear. Teddy bear would play music and flash eyes while being held in a drinking position. Inside a teddy bear there is installed a totally new kind of device for playing music and flashing eyes. This item can solve many problems aroused during the process of feeding a child and can improve comfort in a child and caregiver's daily life.

1 Claim, 3 Drawing Sheets

BABY BOTTLE COMBINED WITH MUSICAL TEDDY BEAR

CROSS-REFERENCES TO RELATED APPLICATION

D74251 January, 1928 Bettoll et al. D24/198
D287767 January, 1987 Simmons D24/198
D303431 Sep., 1989 Brown D24/198
D326158 May., 1992 Katz et al. D24/198
D379659 June, 1997 Alston D24/198
D450, 852 Nov., 20, 2001 Williams D24/197
D430,301 Aug., 2000 Pfiflner D24/197
D428656 Jul. 25, 2000 lexander,et al. D24/197
U.S. Pat. No. 1,589,138 June, 1926 Fisk 215/11
U.S. Pat. No. 2,929,290 March, 1960 Smith 215/11
U.S. Pat. No. 3,226,528 December, 1965 Martin 369/63
U.S. Pat. No. 3,627,161 December, 1971 Wergeland 215/11
U.S. Pat. No. 5,316,160 May., 31, 1994 Cautereels 215/11
U.S. Pat. No. 4,678,093 Jul., 7, 1987 Allen 215/11

BACKGROUND OF THE INVENTION

Baby bottles have been in continuous use for many years. They play an important role in an infant's life. They are used for nursing and feeding of infant children.

During feeding a child there arise different kind of problems: some children don't have good appetite, some of them are simply lazy to eat up their portion, some of them need some kind of entertainment and etc. Such kind of problems aren't convenient not only for a child but for caregivers as well. In order to solve these problems it's very important in what kind of bottle can be presented food to a child. Baby bottle should make feeding process enjoyable and comfortable for both a child and a caregiver.

Over the years there was an attempt to take these problems into consideration and invent appropriate baby bottles. But most of the inventions focus on presenting mostly new shapes of the bottles. Nowadays there exist baby bottles with various forms, shapes and configurations. Among them there are inventions that provide baby bottles with the shape of different toys as well. Besides there also exist invention that presents music in a baby bottle. The music device is installed inside a bottle on the interior of base section. The music is activated in the bottle by mercury switch that is electrically connected to the microchip having musical information. But as it is known mercury isn't healthy for a human being. Safety of the health should be priority issue while presenting a new item and especially it's very important when it deals with a child The present invention approaches to the above-mentioned problems on a more serious level and presents a new solution to these problems that can bring more convenience and comfort to both to a child and a caregiver during feeding process.

SUMMARY OF THE INVENTION

The object of the invention is a baby bottle combined with a musical teddy bear. The item would consist of a stuffed teddy bear into which a standard size baby bottle could be inserted. The bear would have flashing eyes and would play music while a child drinks. These features would be activated by a special device installed in a teddy bear. The second object of this invention is the device that activates music and flashing eyes. This invention presents a new solution to the problems concerning feeding process of a child. The privilege of this solution to the existed ones is to deal with the problems identified in the background of the invention on a more serious level.

The prior inventions concerning baby bottles mostly concentrate on presenting different kinds of shapes of bottles themselves. This invention is a new way of finding out a totally new design for a baby bottle. It doesn't change a shape of a baby bottle itself. It presents a baby bottle with the combination of children's one of the most favorite toy—teddy bear.

Another difference from the existed inventions is that it presents not only plain toy but toy with music and flashing eyes. The fact that teddy bear would play music and have flashing eyes makes this toy more interesting and can solve the problems existing at the feeding process of a child better.

The third distinguishing feature of the invention is to present a totally new way of activating music and flashing eyes: to use not mercury switch as the prior inventions do and that isn't safe for the health of a child but present a totally new way of activating music and flashing eyes that is absolutely safe for the health of a child.

BRIEF DESCRIPTION OF THE DRAWINGS

The objects, features and advantages of the present invention will become more fully apparent from the accompanying drawings in which.

DETAILED DESCRIPTION OF THE PREFERRED EMBODIMENT

Figure 1:
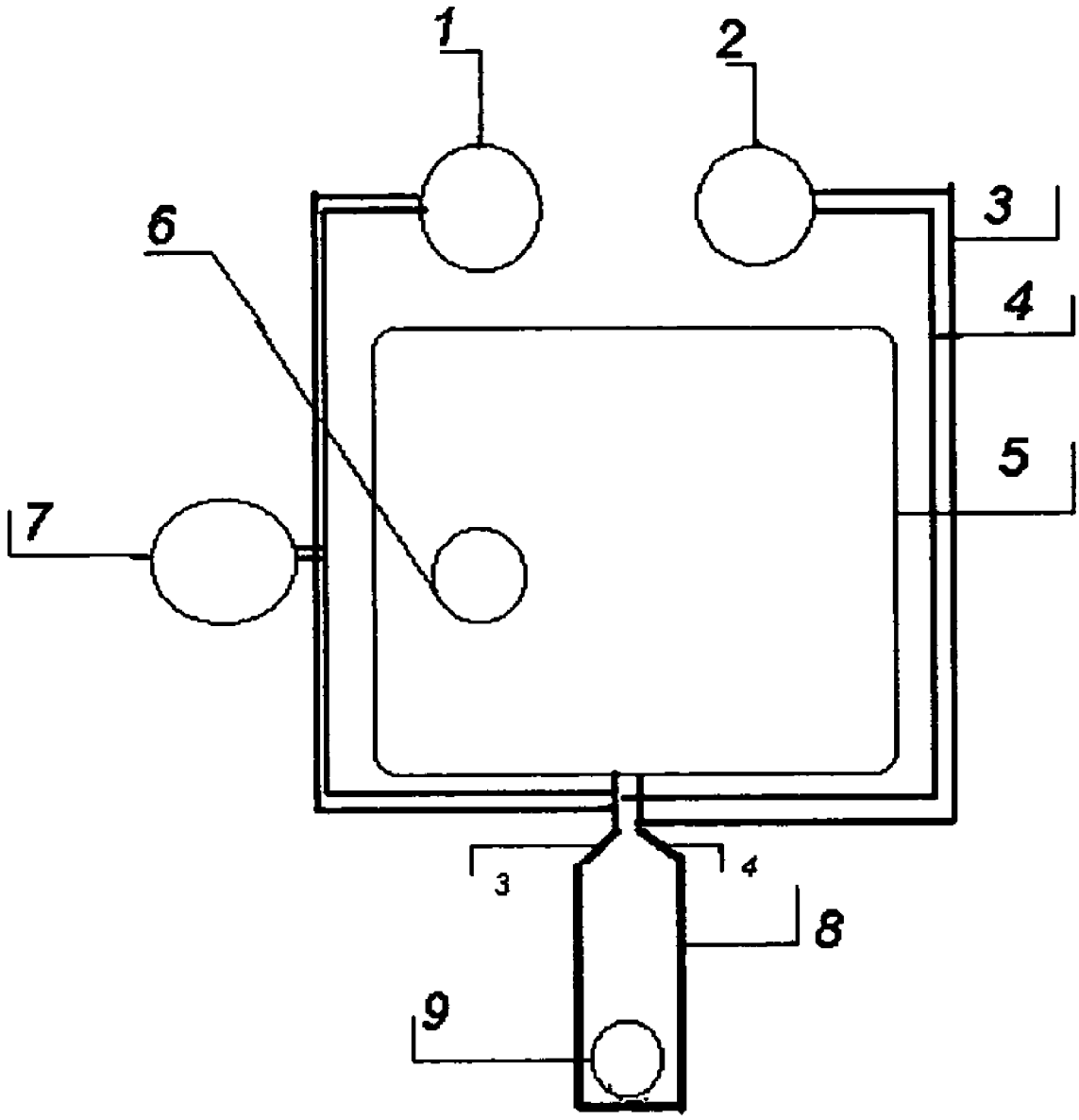
FIG. 1 shows the view of the device installed in a teddy bear holder.

This invention presents a baby bottle combined with a musical teddy bear. FIG. 1 presents the invented device that is installed in teddy bear and makes music and flashing eyes while being held in a drinking position. It presents two blinking lamps (1) in a bear's left eye that is electrically connected with the microchip and activated (flashes) while holding a bear in drinking position when the ball touches the electric wires (3, 4), a blinking lamp in the bear's right eye that is electrically connected with the microchip and activated (flashes) while holding a bear in drinking position when the ball touches the electric wires (3), electric wire that is connected with the blinking lamps in the bear's eyes with one end and with the microchip with the other end, electric wire (4) that is connected with the blinking lamps in the bear's eyes with one end and with the microchip with the other end, the microchip (5) that has musical information. Music is activated while holding a bear in drinking position, a battery (6), a speaker (7) that makes music to be heard, a tube (8) that is electrically connected to the microchip. Inside a tube there is a metallic ball (9) that is situated on the bottom of the tube while the bear is in a vertical position. While holding the bear in drinking position the ball rolls over towards the electric wires and when it touches them the music is activated.

Figure 2:
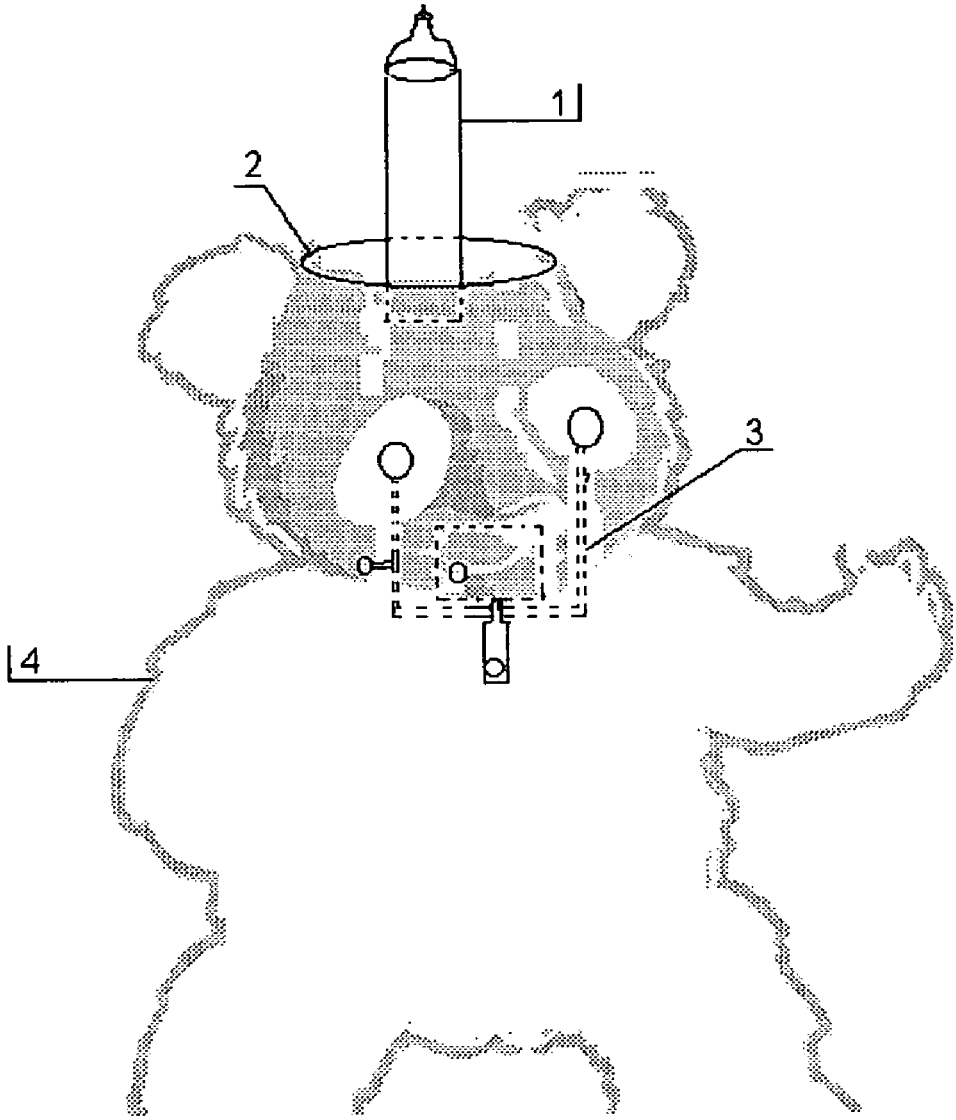
FIG. 2 shows the view of the item showing the components of the whole items.

FIG. 2 presents the view showing the components of the whole item in which is a baby bottle that is removable and should be placed inside a teddy bear holder, a ring (2) that covers the top of the head of the bear and protects the nipple of the baby bottle from the texture of teddy bear. The device that makes music and flashes eyes inside teddy bear.

Figure 3:
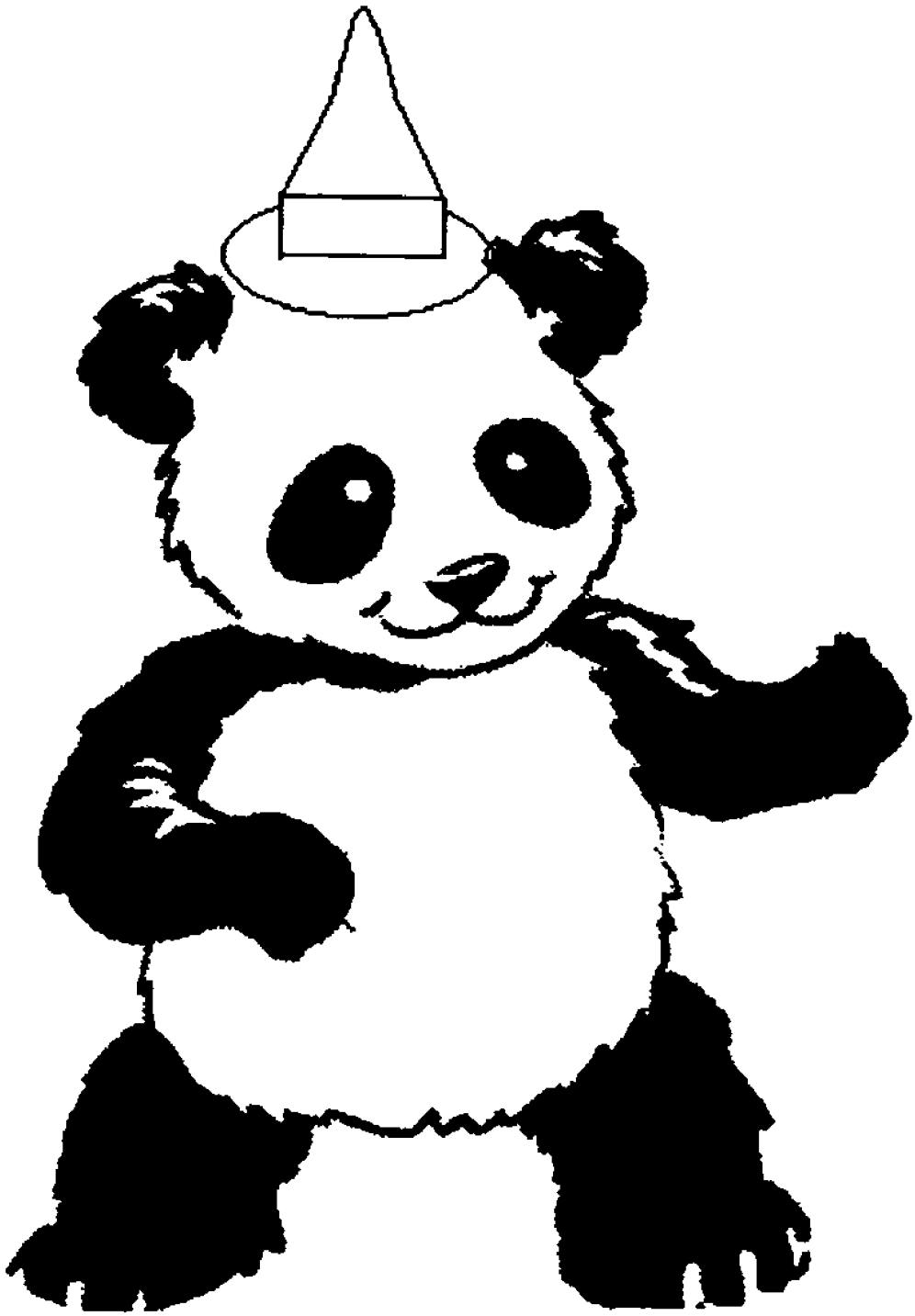
FIG. 3 shows the completely assembled item of FIGS. 1 and 2.

FIG. 3 presents the view of the completely assembled item. It presents 1) the nipple of the baby bottle. The bottle is removable and is placed inside a teddy bear holder. 2) The plastic ring that covers the top of the head of teddy bear and protects the nipple from the texture of teddy bear. 3) a stuffed teddy bear that holds a baby bottle and makes music and flashes eyes while holding a bear in drinking position.

The present invention provides a baby bottle combined with a musical teddy bear. A standard size baby bottle is inserted in a stuffed teddy bear. The bear would have a ring on the top of the head in order to protect the nipple from the texture of teddy bear. The bear would play music and his eyes would flash while holding the bottle in a drinking position.

There is presented a totally new device for activating music and flashing eyes in teddy bear. The special device is installed inside a teddy bear. The device is placed vertically in teddy bear. It must be unbreakable and unreachable for a child. The device comprises a tube. The bottom section of the tube is closed. On the top section of the tube there is placed a speaker that is electrically connected to the microchip having musical information. A battery is also electrically connected to the microchip. From the microchip there comes two wires: plus and minus that goes inside the tube. The wires aren't completely connected with each other. There is a little space between them. Blinking lamps are installed inside the eyes and also connected with the wires to the power source. A small metal ball is inside the tube. On the off-vertical position the ball is on the bottom section of the tube. By changing the position of the bear, from off to on, from vertical to drinking position the metal ball rolls over towards the two wires (plus and minus) and with the touch to the wires causes connection of the two wires (plus and minus) that results in activating music and flashing eyes of teddy bear.

For the interest of enhancing production or deriving a broader user appeal there could be used various sizes and different colors of teddy bear in order to make this item more appealing to a wider range of end users. Different multicolor and decorative design would be excellent stimulation for a child.

A plastic sleeve like insert could be positioned vertically inside this product to allow a consumer to easily insert a baby bottle in a teddy bear.

As for the material for a teddy bear it could be constructed from an acrylic fabric or false fur and padded with polyester fiber filing.

This invention has the following main distinguishing features to the already existed ones:

1. This item has a unique design. This invention doesn't represent a configuration of the shape of a baby bottle itself that most of the prior inventions do but for the first time presents a combination of a baby bottle and a toy. As a toy there is specially picked up one of the most favorite toys for children—a teddy bear.

2. New elements are added to the teddy bear holder: music and flashing eyes. They would be activated in teddy bear while being held in drinking position.

3. For the first time there is presented a new way of activating music and flashing eyes in an item. Instead of mercury switch that was presented to the prior invention this invention provides such new device that is absolutely safe for a child's health.

The invented item has the following functions:

a. This item has a practical appeal to a bottle. It's a holder of a baby bottle. It would consist of a stuffed teddy bear into which a standard size baby bottle could be inserted.

b. The bottle inserted in this holder retains its warmth for a longer period of time By inserting a bottle into this padded holder a baby bottle could be kept warm for a longer period of time. This could eliminate spoilage or the need for a caregiver.

c. This item can provide a visual stimulation to a child. By offering the product in a variety of colors and styles, a consumer could purchase a unit that he feels would be appealing to his child. Teddy bear should be available in a wide variety of bright and also multi-colored design. It could be a delightful object for a child to look at.

d. Finding a bottle with combination of teddy bear having soft, cuddly exterior of teddy bear would be fun for a child to explore. As pediatricians recommend every new item including this would encourage infants to explore different shapes and textures to learn about the world around them.

e. A teddy bear's plush body would provide tactile stimulation. The toy—holder could encourage a child to hold his own bottle and the bottle together with the toy would be pleasant and delightful for a child to hold it while drinking, thereby relieving a caregiver from this responsibility. Its plush body would provide tactile stimulation and could be pleasant for the child to hold.

f. This item can provide comfort for a child. This product can hold a child's attention while he drinks from the bottle and could lead to a more peaceful and enjoyable feeding for both a child and a caregiver. In addition to being used in the home this product could also be utilized in day care centers and hospitals that provide care for infants. This item can provide comfort for a child who is separated from his parents or primary caregiver and make his feeding time more pleasant.

g. This product idea could have appeal as a gift item for parents, friends and relatives.

h. The music and flashing eyes in a teddy bear can have two benefits for feeding process:

i) Entertainment value: While playing music a child can hear soothing entertaining tunes that can make him calm down. Teddy bear can provide entertainment to a child while drinking from the bottle.

ii) Appetite stimulator:

The music can be played every time exactly before starting of feeding. It would help a child to get the habit to get ready for food at exactly hearing music played by this teddy bear.

The music can be played every time only at the time while a child has food from this bottle. The fact that teddy bear plays music only at the time when a child drinks from the bottle would give him motivation to drink more and more. So it would stimulate his appetite. This could be benefit to especially such kind of children who have less appetite or simply are lazy to eat normal portion of their food. It would also be helpful for a caregiver to overcome such kind of problem with these kind of children.

What is claimed is:

1. A Baby bottle combined with stuffed teddy bear comprising:

a baby bottle being placed inside the stuffed teddy bear;

stuffed teddy bear comprising:

a pair of blinking lamps electrically connected to a battery and located at the stuffed teddy bear's eyes;

a speaker electrically connected to a musical microchip and the battery;

a conductive ball movably inside a hollow tub body;

a pair of separated electrodes located at the tub neck and electrically connected between said battery, musical microchip, and blinking lamps;

when said teddy bear is in drinking position, said ball rolls over towards to the electrodes and causes connection of the electrodes that results in activating music and blinking eyes.

* * * * *